US008984837B2

(12) United States Patent
Curtis et al.

(10) Patent No.: US 8,984,837 B2
(45) Date of Patent: Mar. 24, 2015

(54) MASONRY WALL WIRE REINFORCEMENT APPARATUS AND METHODS THEREOF

(71) Applicant: Heckmann Building Products Inc., Melrose Park, IL (US)

(72) Inventors: Paul Curtis, Berwyn, IL (US); David Sanchez, Brookfield, IL (US)

(73) Assignee: Heckmann Building Products Inc., Melrose Park, IL (US)

( * ) Notice: Subject to any disclaimer, the term of this patent is extended or adjusted under 35 U.S.C. 154(b) by 0 days.

(21) Appl. No.: 14/189,764

(22) Filed: Feb. 25, 2014

(65) Prior Publication Data

US 2014/0311071 A1 Oct. 23, 2014

Related U.S. Application Data

(60) Provisional application No. 61/768,971, filed on Feb. 25, 2013.

(51) Int. Cl.

| | |
|---|---|
| ***E04B 1/02*** | (2006.01) |
| ***E04C 3/30*** | (2006.01) |
| ***E04B 1/41*** | (2006.01) |
| ***E04B 2/44*** | (2006.01) |
| *E04B 2/56* | (2006.01) |
| *E04B 2/02* | (2006.01) |

(52) U.S. Cl.

CPC ..... *E04B 1/4185* (2013.01); *E04B 2/44* (2013.01); *E04B 2002/565* (2013.01); *E04B 2002/0256* (2013.01)

USPC ..... 52/565; 52/568; 52/379; 52/712; 52/428

(58) Field of Classification Search

USPC ..... 52/562, 565, 568, 379, 712–714, 426, 52/428, 410

See application file for complete search history.

(56) References Cited

U.S. PATENT DOCUMENTS

| | | | | |
|---|---|---|---|---|
| 4,606,163 | A * | 8/1986 | Catani | 52/434 |
| 4,869,038 | A * | 9/1989 | Catani | 52/410 |
| 4,875,319 | A * | 10/1989 | Hohmann | 52/383 |
| 5,454,200 | A * | 10/1995 | Hohmann | 52/513 |
| 5,671,578 | A * | 9/1997 | Hohmann | 52/562 |
| 5,816,008 | A * | 10/1998 | Hohmann | 52/565 |
| 6,668,505 | B1 * | 12/2003 | Hohmann et al. | 52/565 |
| 7,017,318 | B1 * | 3/2006 | Hohmann et al. | 52/562 |
| 8,555,587 | B2 * | 10/2013 | Hohmann, Jr. | 52/379 |

* cited by examiner

*Primary Examiner* — Brian Glessner
*Assistant Examiner* — Brian D Mattei
(74) *Attorney, Agent, or Firm* — Jeffrey A. Pine; Dykema Gossett PLLC

(57) ABSTRACT

A masonry wire reinforcement apparatus and system is disclosed for anchoring a veneer wall to a backup wall of Concrete Masonry Units using a masonry wire reinforcement product embedded into an inner support wall, along with clips and pintle ties, such that the clip is attached to the masonry wire reinforcement product and is configured to receive the pintle tie, which then is attached to the veneer wall. Also disclosed is a thermal attachment that can be attached to the clip and accept the pintle tie thereby reducing the transfer of energy from the outer veneer wall to the inner support wall.

14 Claims, 7 Drawing Sheets

Ladder type

Truss type

MASONRY WALL WIRE REINFORCEMENT APPARATUS AND METHODS THEREOF

PRIORITY STATEMENT

This application claims the benefit of U.S. Provisional Application No. 61/768,971, filed Feb. 25, 2013.

FIELD OF THE INVENTION

The present invention relates generally to a masonry wall wire reinforcement apparatus and system for anchoring a veneer wall to a backup wall of Concrete Masonry Units and, more specifically, the present invention relates generally to a system and apparatus for connecting a veneer wall to a backup wall using wire ladder or truss type reinforcement along with a clip that can be attached to the wire reinforcement and can be configured to receive the pintle tie, which then is embedded in the veneer wall. Further, an optional thermal attachment is available to be placed between the pintle tie and the clip to reduce thermal transfer.

BACKGROUND OF THE INVENTION

In many cases, construction of a wall of a building includes a backup wall made up of numerous cinder or concrete blocks, otherwise known as, Concrete Masonry Units (CMU) placed next to each other in rows, with multiple rows placed on top of each other. These CMU are connected to each other using mortar. A veneer wall is then built in front of the backup wall with a space or cavity between the two walls. The veneer wall may be, for example, made up of bricks.

In order to increase the strength of the walls, wire joint reinforcement is inserted between the rows of CMU during the mortar process, such that the wire joint reinforcement is placed in the mortar joint between the CMU. According to code, wire reinforcement may be placed on top of every row, or every other row. Depending on the configuration the wire reinforcement can be installed in the backup and the pintle ties slipped into the clip and built into the veneer so the two walls can be built together. By connecting the two walls, the wire reinforcement can establish a positive lateral load connection between the veneer wall and the backup wall.

Further, the space between the backup wall and the veneer wall may have insulation, often a rigid wall insulation, between the two walls. The system for attaching the backup wall to the veneer wall must take this insulation into account, including the possibility that the insulation will require an opening to allow the wire reinforcement to pass through from the backup wall to the veneer wall.

One of the disadvantages of this construction process is that when the veneer wall is built, the rows and joints of the two different walls are not necessarily aligned in the vertical direction. As such, the wire joint reinforcement in the backup wall must be adjusted or adjustable to allow for the vertical difference in the joints or rows of the veneer wall. One way to overcome this problem, is to use a "pintle and eye" system in which the wire reinforcement consists of wire eyes that extend out past the CMU and past the insulation, such that a pintle tie can be placed into the eye of the wire reinforcement and adjusted vertically to "meet" the height of the veneer wall. In addition, current masonry codes require cavity walls with a CMU backup and brick veneer to have two-piece adjustable anchors that allow vertical deflection between the two parts. This type of wire reinforcement can be utilized with either a ladder or truss type wire reinforcement system.

However, there are a number of different size wire reinforcement for the different CMU thicknesses and different sized wire gauges. Further, there are different materials or coatings that can be used for each of the different sizes, and there is a necessity to provide various eye lengths to compensate for the different thickness of insulation. With the varying size wires and thicknesses, there will be many different sized products that can be generated for different projects, making it extremely difficult and unnecessarily expensive to budget for inventory purposes.

Another concern with the pintle and eye products on the market today is that the veneer wall, which may be subjected to outdoor elements such as heat or cold, will transmit the heat or cold through the metal pintle and eye product to the backup wall, which will then be more easily transmitted to the inside of the structure. There is no thermal break to minimize this unwanted thermal flow from the outside of the structure to the inside.

Yet another shortcoming of the current pintle and eye products for masonry wall wire reinforcement occurs when the product is shipped. With the current configuration, i.e., the ladder or truss type with the eye portion extending outward, the eye portion may become damaged during shipping. Avoiding damage to the eye portion forces extra amount of care or better packaging when shipping the product.

Thus, there is a long felt need in the field of masonry wall wire reinforcement for a more cost-effective reinforcement system that can reduce the need for many of the parts in one's inventory and also serve as a thermal break to reduce the thermal transfer or flow of energy from the outside to the inside of a structure. There is also a need to reduce cost and limit damage exposure of the product during shipping. The present invention overcomes these and other disadvantages relating to masonry wall reinforcement systems.

SUMMARY OF THE INVENTION

The present invention discloses a new and improved masonry wall wire reinforcement system, which is intended to establish a positive lateral load connection between the outer veneer wall and the inner backup, masonry or supportive wall. The present invention generally includes a masonry wall wire reinforcement apparatus or product, a clip or in some cases multiple clips, and a pintle or wire tie.

The present invention discloses a clip configured to be attached to the masonry wall wire reinforcement product for allowing the insertion of the pintle tie that will be attached to the veneer wall. The present invention may also utilize a separate thermal attachment to be attached or placed on the clip to act as a thermal break and reduce the transfer of energy, in the form of hot or cold temperatures, from travelling from the outside of the veneer wall to the inside of the masonry wall.

The present invention allows for a reduction in parts in inventory, while still allowing the ability to generate the same number of different types and size masonry wall wire reinforcement products for different job requirements. By attaching the correct sized clip (and/or thermal attachment) to the wire reinforcement product, usually at the job site, many different sized masonry wall wire reinforcement products can be produced from fewer components.

In accordance with the present invention, a masonry wall wire reinforcement apparatus and system is provided that includes a clip configured with at least one support, such as a groove, hook, clasp or indent (these may be used interchangeably herein) at one end of the clip to receive and hold the wires of the masonry wall wire reinforcement product, whether that reinforcement product is a ladder or truss type product. The clip contains at least one opening at the opposite end of the grooves that are sized to accept the ends of a pintle tie for connecting the backup wall to the veneer wall. Different clips may be used, depending on the distance requirement between the backup wall and the veneer wall. Further, different opening sizes and shapes can be used depending on the size of the pintle tie required. Either way, the same masonry wall wire reinforcement product can be used, with the correct sized clip to be "clipped" onto the reinforcement product to make the required apparatus.

Accordingly, and in accordance with the present invention, a masonry wall wire reinforcement apparatus and system is provided that includes a clip containing grooves at one end that receive and support the wires of a ladder type or truss type masonry wall wire reinforcement product. The clip contains openings at the other end that accept a pintle tie for connecting the backup wall to the veneer wall, thereby minimizing the number of different masonry wall wire reinforcement products that have to be manufactured and kept in inventory.

In accordance with the present invention, a masonry wall wire reinforcement apparatus and system is provided that includes a clip containing grooves at one end that receive and support the wires of a ladder type or truss type masonry wall wire reinforcement product, with openings at the other end of the clip that accept the pintle tie for connecting the backup wall to the veneer wall. The clip is further configured to accept and support a thermal break attachment which may be attached to the clip and provide pintle tie openings or thermal attachment openings for accepting the pintle tie. This configuration acts to minimize the transfer of thermal energy from the outside of the veneer wall to the inside of the backup wall.

In accordance with the present invention, the masonry wall wire reinforcement apparatus and system containing a clip with grooves and openings for accepting the pintle tie and for connecting the backup wall to the veneer wall provides for a reduction in packaging costs and damage to the product when shipped.

The present invention, a masonry wall wire reinforcement apparatus and system has numerous configurations that are covered by the scope of the present invention and the foregoing and other aspects, features, details, utilities, and advantages of the present teachings will become apparent from reading the following description and claims, and from reviewing the accompanying drawings.

BRIEF DESCRIPTION OF THE DRAWINGS

The preferred embodiments of the invention will be described in conjunction with the appended drawings, which illustrate and do not limit the invention, where like designations denote like elements, and in which.

DETAILED DESCRIPTION OF EMBODIMENTS OF THE INVENTION

The present disclosure concerns a new and improved masonry wall wire reinforcement apparatus and system. The apparatus and system is intended to establish a positive lateral load connection between an outer veneer wall and an inner backup wall, otherwise known as a supportive wall. The veneer wall may be made up of aesthetic brick, while the inner wall may be made up of Concrete Masonry Units or CMU. The present invention generally includes a masonry wall wire reinforcement product or wire reinforcement, along with a clip, or in some cases multiple clips, and a pintle or wire tie.

In general use and as disclosed in detail herein, the present invention allows for the clip to be attached to the masonry wall wire reinforcement product, which is placed in between the layers of bricks of the backup wall. The clips are configured to extend out from the backup wall and allow for a pintle tie to be inserted into the openings of the clip. The veneer wall can then be built with the opposite end of the pintle tie being located and secured in between the layers of the veneer wall.

As further disclosed herein, the present invention may also utilize a separate thermal attachment to be placed on the clip to act as a thermal break and reduce the transfer of energy from travelling from the outside of the veneer wall (where it is usually subject to environmental conditions) to the inside of the backup wall, which is usually closest to the inside of the structure being built.

Figure 1:
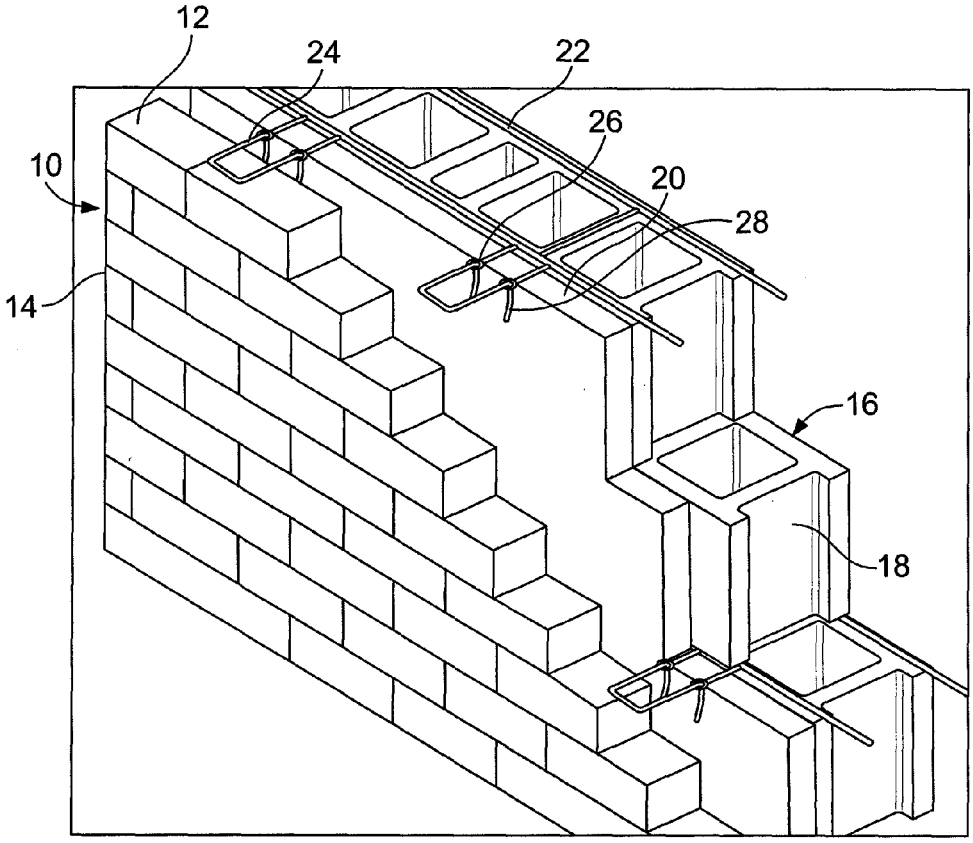
FIG. 1 is a sectional view of a masonry veneer wall and a supportive wall having a partial masonry wall wire reinforcement product.

FIG. 1 is a cut away figure showing the prior art for the present invention. As shown, the outer veneer wall 10 can be formed, for example, from bricks 12 that are joined to one another by mortar or other cementitious material 14. In some embodiments, the inner structural supportive wall 16 may be formed by Cement Masonry Units or CMU 18, which are also joined to other CMU by mortar or the like (not shown). Further, an outer insulation layer 20 of hard, rigid, fire-resistant insulation, such as that sold by Weyerhaeuser under the brand name ULTRABOARD® or that sold by Dow Building Products under the brand name CAVITYMATE® for example, may also be used in the construction of the structure.

To connect the masonry wall 16 to the veneer wall 10, a masonry wire reinforcement product 22 is used along with pintle ties 24. The masonry wire reinforcement product 22 is placed on top of a layer of CMU 18 making up the inner or supportive wall 16 and mortar is placed on the top of the layer, before the next layer of CMU 18 are put in place.

As shown in FIG. 1, the masonry wire reinforcement product 22 has a number of eyes 26 extending from the masonry wire reinforcement product 22 such that after the layer of CMU 18 have been put in place, the eyes 26 extend from the inner wall 16. These eyes 26 are usually welded onto the masonry wire reinforcement product 22 in locations based on the design requirements of the structure. As shown in FIG. 1, the eyes are used in a double eye anchor configuration so that a pintle tie 24 having two ends 28 can be used for fastening the inner wall 16 to the veneer wall 10.

As understood by one having ordinary skill in the art, the distance that the eye 26 extends from the inner wall 16 is based on the design of the structure and may also take into account the thickness of the outer insulation layer 20 due to insulation demands. Once the inner wall 16 has been built, the outer insulation layer 20 of insulation can be pressed onto the inner wall 16 so that the eyes 26 of the masonry wire reinforcement product 22 poke through the outer insulation layer 20 and can be accessed from the outside of the outer insulation layer 20.

Next, the pintle ties or wires 24 can be located into the eyes 26 of the masonry wire reinforcement product 22. To do so, the two ends 28 of the pintle tie 24 are placed into the eyes 26 of the masonry wire reinforcement product 22. The pintle tie 24 and eye 26 combination allows for the pintle tie 24 to be positioned vertically as needed.

Next, the outer or veneer wall 10 is built by placing bricks 12 next to and on top of each other while using mortar 14 to hold the bricks 12 together. As the veneer wall 10 approaches a pintle tie 24 that has been placed into the eyes 26 of the masonry wire reinforcement product 22, the pintle tie 24 can be positioned vertically to be placed above one and below another brick 12 as the mortar 14 holds the brick 14 and tie 24 in place. Once the mortar 14 has set, the inner wall 16 will be connected to the veneer wall 10 using the masonry wire reinforcement product 22 and the pintle tie 24.

Figure 2:
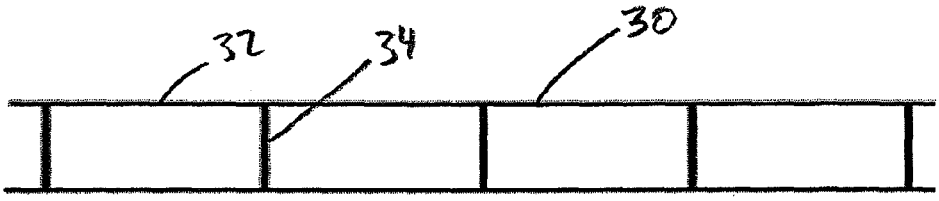
FIG. 2 is a frontal view of different types of wall reinforcement products.
Figure 2:
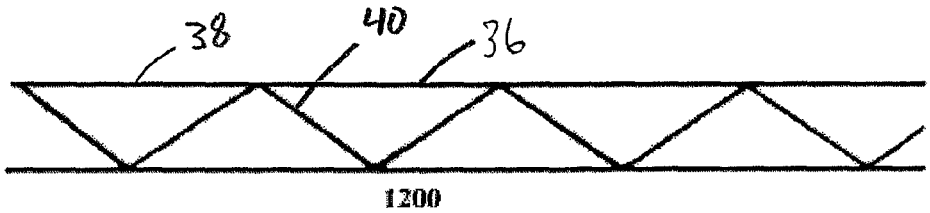

FIG. 2 shows a masonry wire reinforcement product 22 as described above, in which a ladder type configuration 30 is made up of 90 degree connections between the horizontal struts 32 and the vertical struts 34. Another type of masonry wire reinforcement product 22 is a truss type configuration 36, in which the masonry wire reinforcement product 22 is made up of 45 degree connections between the horizontal struts 38 and the webs 40.

There are typically five or six different size masonry wire reinforcement products 22 depending on the CMU 18 thickness. The masonry wire reinforcement product 22 is usually about 10 feet long and made up of either 9 gauge or 3/16" wire. The masonry wire reinforcement product 22 can be either mill galvanized, hot dip galvanized or stainless steel, such that there are between 30 and 36 different size and type masonry wire reinforcement products 22. Further, the welded eye 26 can be produced in many different lengths to compensate for the different thicknesses of the outer insulation layer 20. If there are only three different length eyes 26, the number of different masonry wire reinforcement product 22 that can be ordered will expand to between 90 and 108 different pieces.

In order to minimize the number of different pieces without decreasing the number of piece options, the present invention comprises either three or four basic components; namely, a masonry wire reinforcement product 22 (without the welded or manufactured eyes 24), a pintle tie 24 (for the preferred embodiment, the pintle tie used with a double eye anchor), and a clip 50 that allows the masonry wire reinforcement product 22 to be connected to the pintle tie 24.

Figure 3:
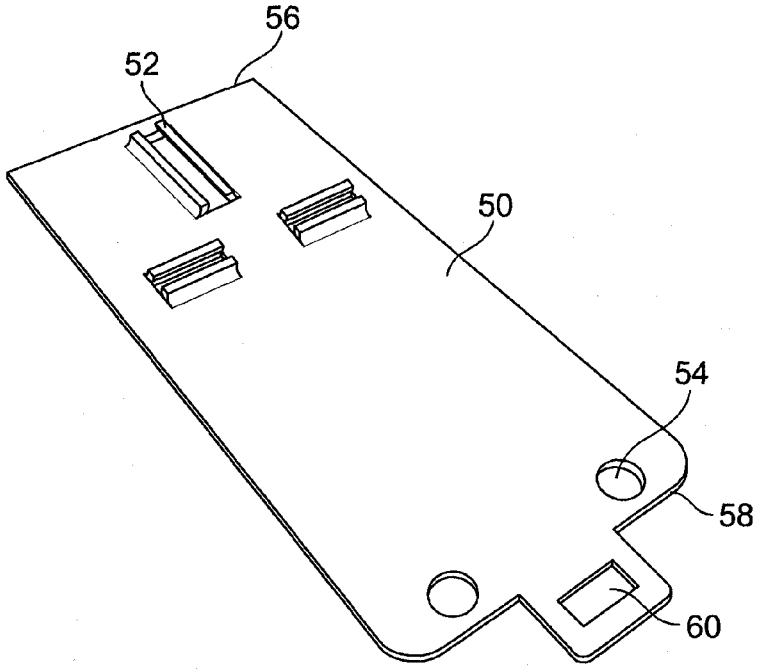
FIG. 3 is a perspective view of a clip for use in a masonry wall wire reinforcement system in accordance with an embodiment of the present invention.

In the embodiment shown in FIG. 3, the clip 50 can be manufactured from stainless steel, but it may also be either mill galvanized, epoxy coated, or hot dip galvanized, among other materials and coatings. The clip 50 includes a number of supports, such as grooves, hooks, clasps, or indents 52 at one end of the clip 50. The grooves 52 are sized and configured to allow for the struts 32, 34, 38 and webs 40 of the masonry wire reinforcement product 22 to be inserted, placed or "snapped" into the grooves 52 and held firmly in place. The clip 50 shown in FIG. 3 is intended to be used with a ladder type 30 wire reinforcement product 22, however, the clip 50 can be configured to be used with a truss type 36 wire reinforcement product 22.

The clip 50 is also configured with two clip openings 54 at the other end of the clip 50 opposite from the grooves 52. These clip openings 54 are used to accept the ends 28 of the pintle ties 24, and allow for the pintle ties 24 to be positioned vertically depending on the height of the bricks 12 of the veneer wall 10. Further, by changing the size of the clip 50 from one end 56 to the other end 58, the effective "location" of the clip openings 54 for the pintle ties 24 can be extended or retracted without the need for generating multiple masonry wire reinforcement products 22; the same masonry wire reinforcement product 22 can be used to generate different opening locations. The clip 50 may also be configured with an opening 60 that would be used to attached and secure a thermal attachment to the clip 50 as described in detail below.

Figure 4:
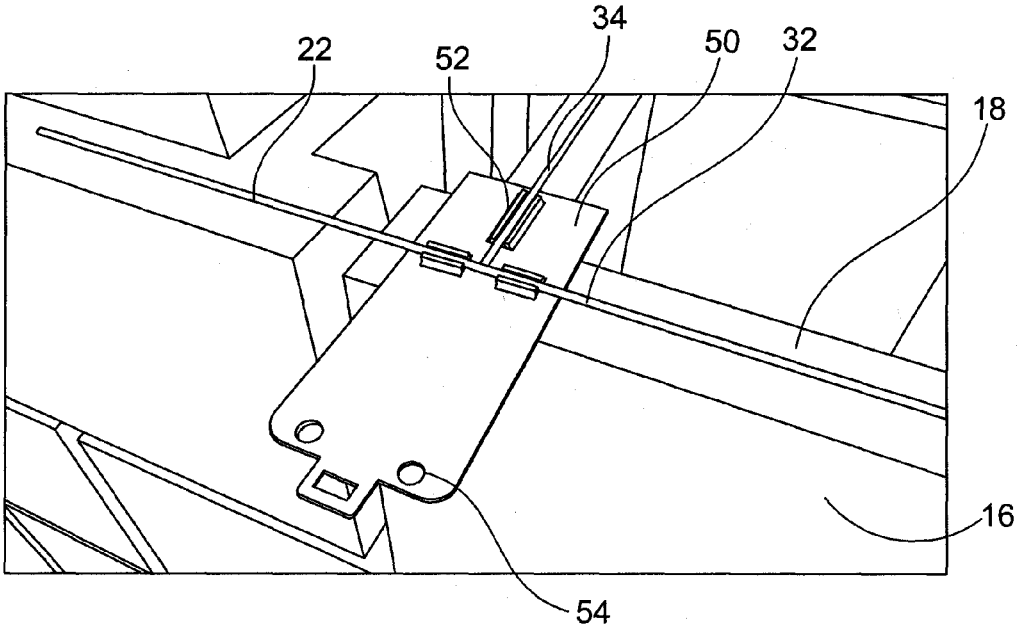
FIG. 4 is a sectional view of a masonry veneer wall and a supportive wall having a masonry wall wire reinforcement system in accordance with an embodiment of the present invention.

With continued primary reference to FIGS. 1 and 3, the clip 50 can be attached to the masonry wire reinforcement product 22 using the grooves 52 as shown in FIG. 4. Once a number of CMU 18 have been placed side-by-side and a layer of the inner wall 16 has been built up, the masonry wire reinforcement product 22 can be located on top of the layer of the inner wall 16. Next, the clip 50 can be snapped into location by inserting the struts 32, 24 into the grooves 52, thereby holding the clip 50 in place on the CMU 18. Mortar can now be placed onto the CMU 18 and the clip 50 and another CMU for the next layer can then be put in place covering up the CMU 18 and clip 50. As shown, the clip 50 will extend out from the inner wall 16 thereby exposing the clip openings 54.

Figure 5:
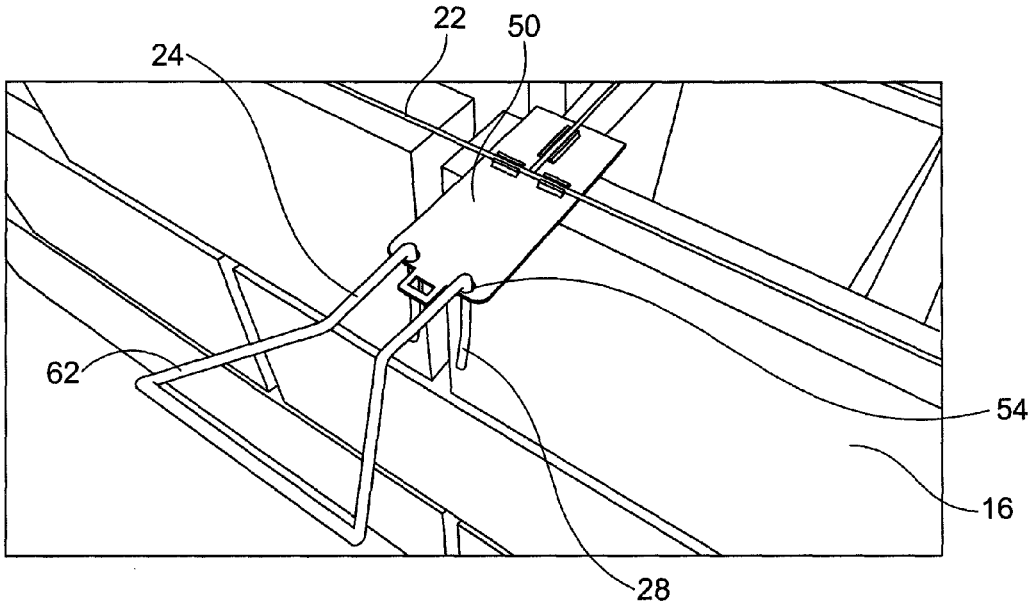
FIG. 5 is a sectional view of a masonry veneer wall and a supportive wall having a masonry wall wire reinforcement system in accordance with an embodiment of the present invention.

The next step is shown in FIG. 5, in which the ends 28 of the pintle tie 24 are placed into the clip openings 54 of the clip 50. This is usually done after the entire inner wall 16 has been built, and after the outer insulation layer 20 has been placed up against the inner wall 16, with the clip openings 54 sticking through the outer insulation layer 20 (see FIG. 1).

The clip 50 may also contain a separate piece of insulation either on the top surface of the clip 50, with a separate piece on the bottom surface of the clip 50 (not shown), as understood by one having ordinary skill in the art. These one or two pieces of insulation can be taped using a specified tape to assist in preventing moisture and air from going through the opening in the insulation and back to the inner wall 16.

As described herein, the structure (after the outer insulation layer 20 has been placed on the inner wall 16) is now ready for the veneer wall 10 to be built and the front 62 of the pintle tie 24 to be placed between the bricks 12 of the veneer wall 10 as it is being built.

As further described herein, a thermal attachment 70 can be used in addition to the masonry wire reinforcement system of the present invention. As such, the system would be comprised of four components; namely, the masonry wire reinforcement product 22, the pintle tie 24, the clip 50 and the thermal attachment 70 that is configured to be attached to the clip 50 and which allows the masonry wire reinforcement product 22 to be connected to the pintle tie 24.

Figure 6:
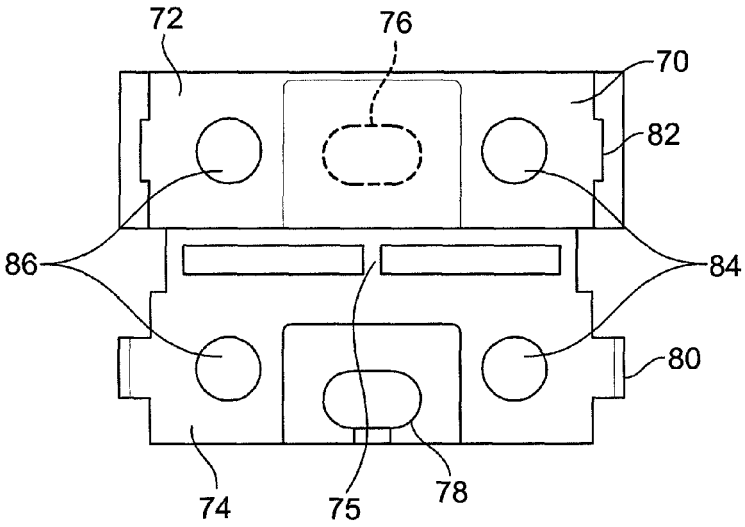
FIG. 6 is a frontal view of a thermal attachment for use in a masonry wall wire reinforcement system in accordance with an alternative embodiment of the present invention.

FIG. 6 shows the thermal attachment 70 in its opened or pre-attached state. The thermal attachment 70 is manufactured with a first side 72 and a second side 74, which are to be folded in half at the hinge or hinges 75 over the opening 60 of the clip 50. In doing so, the thermal attachment 70 in its closed position will be attached to the clip 50.

First side 72 of the thermal attachment 70 is configured with at least one tab or peg 76 and the second side 74 may be configured with at least one indent 78. Although an indent may not be necessary to properly contain and secure the clip 50. When the thermal attachment 70 is folded in half over the hinges 75 and the first side 72 makes contact with second side 74, the at least one tab 76 contacts and is secured into the at least one indent 78. During closing, the peg is placed through the opening 60 of the clip 50, thereby securing the thermal attachment 70 to the clip 50.

As the thermal attachment 70 is closed over the clip 50, at least one end tab 80 on either the first side 72 or the second side 74 makes contact with and locks in place with at least one end indent 82, to hold and secure the two sides 72, 74 of the thermal attachment 70 in the folded or closed position. Further, the first side 72 and second side 74 each contain openings 84, 86 such that the corresponding openings line up when the thermal attachment 70 is folded in half or closed over the clip 50.

To use the thermal attachment 70, after the inner wall 16 has been built with the clips 50 extending outward, and after the outer insulation layer 20 has been placed over the clips 50, and before the pintle ties 24 are placed into the clip openings 54 of the clips 50, the thermal attachment 70 may be placed over the opening 60 and onto the clip 50 as described above. This is accomplished by folding the first side 72 of the thermal attachment 70 over to the second side 74 such that the tab 76 is inserted through the opening 60 and makes contact with the indent 78. The end tabs 80 then lock into the end indents 82 thereby locking the thermal attachment 70 onto the clip 50.

Figure 7:
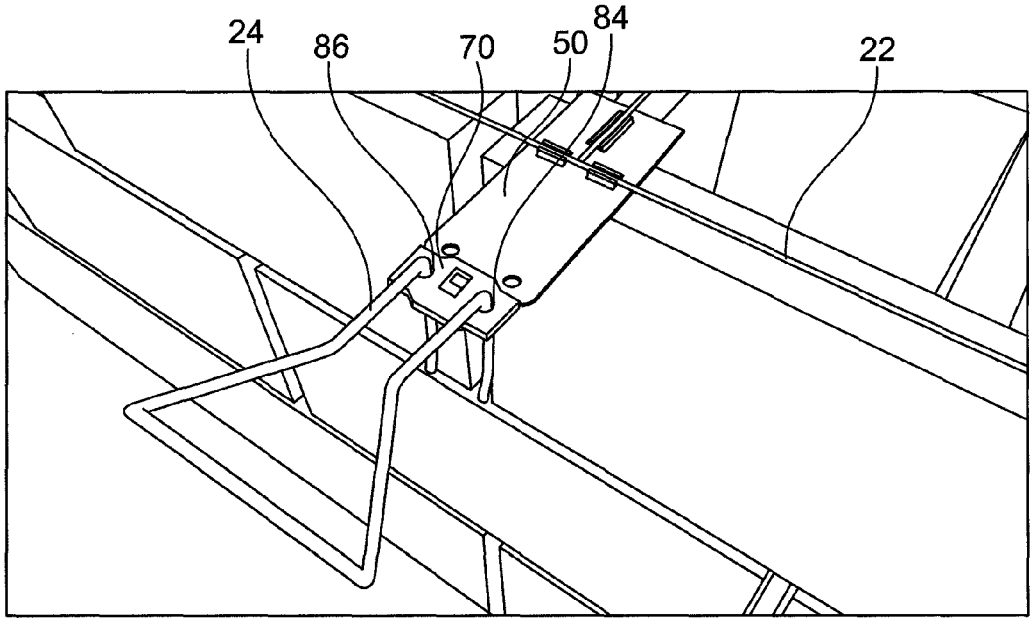
FIG. 7 is a sectional view of a masonry veneer wall and a supportive wall having a masonry wall wire reinforcement system in accordance with an alternative embodiment of the present invention.

As shown in FIG. 7, once the thermal attachment 70 is attached to the clip 50, the pintle ties 24 can be inserted into the openings 84, 86 of the thermal attachment 70 (instead of through the openings 54 of the clip 50) and the veneer wall 10 can be built as described herein.

The thermal attachment 70 can be manufactured from any material that will act as a thermal barrier to reduce the transfer of energy from the outer wall 16 to the inner wall 10. These materials include composite materials, such as plastic or a plastic resin, such as RADEL®, which will act as a thermal break between the inner wall 16 and the veneer outer wall 10. While the clip 50 may also be formed from a metal, such as a zinc alloy, stainless steel, or the like as described above, both the clip 50 and the thermal attachment 70 may also be formed from a combination of those plastics and metals described herein while staying within the scope of the present invention.

Additionally, other configurations of clips and thermal attachments can be used to attain the same results as those described herein. For examples of additional thermal attachments, see U.S. Provisional Patent Application No. 61/602,178 entitled WING NUT ATTACHMENT APPARATUS FOR MASONRY ANCHORS AND METHODS THEREOF, and U.S. patent application Ser. No. 13,776,048 entitled THERMAL CLIP ATTACHMENT APPARATUS FOR MASONRY ANCHORS AND METHODS THEREOF, both said applications being incorporated by reference herein.

Figure 8:
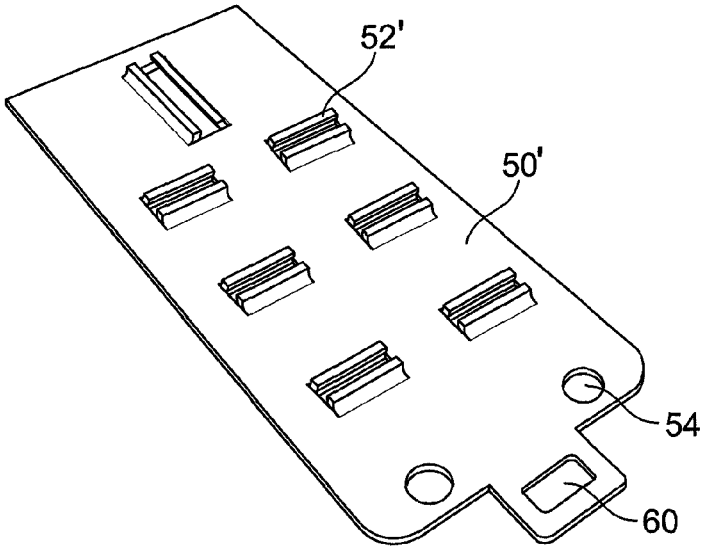
FIG. 8 is a frontal view of a thermal attachment for use in a masonry wall wire reinforcement system in accordance with an alternative embodiment of the present invention.

FIG. 8 shows another embodiment of the present invention in which a clip 50' is manufactured for attachment to the masonry wire reinforcement product 22, and which allows for the insertion of a pintle tie 24 into the clip openings 54 or the attachment of a thermal attachment 70 using the opening 60 of the clip 50'. In this alternative embodiment, the clip 50' is configured with additional grooves 52', in this case, grooves 52' can accept and secure the struts 32, 34 of a ladder type masonry wire reinforcement product 22. As also described herein, the clip 50' is not necessarily limited to a ladder type masonry wire reinforcement product 22 as by arranging the grooves 52' in a different configuration, other types of masonry wire reinforcement product, such as truss type product, can be incorporated into the system of the present invention.

By using multiple grooves 52' in the clip 50', the same clip 52' can be used to obtain different lengths of extension from the end of the inner wall 16 (or the outer insulation layer 20) out to the required location for the clip openings 54 for the pintle ties 24. Simply by using a different pair of grooves 52' to attach to the struts 32, the clip openings 54 will reach out farther. As such, the number of different sized clips 50 can be reduced using the clip 50' with multiple grooves 52'.

Figure 9:
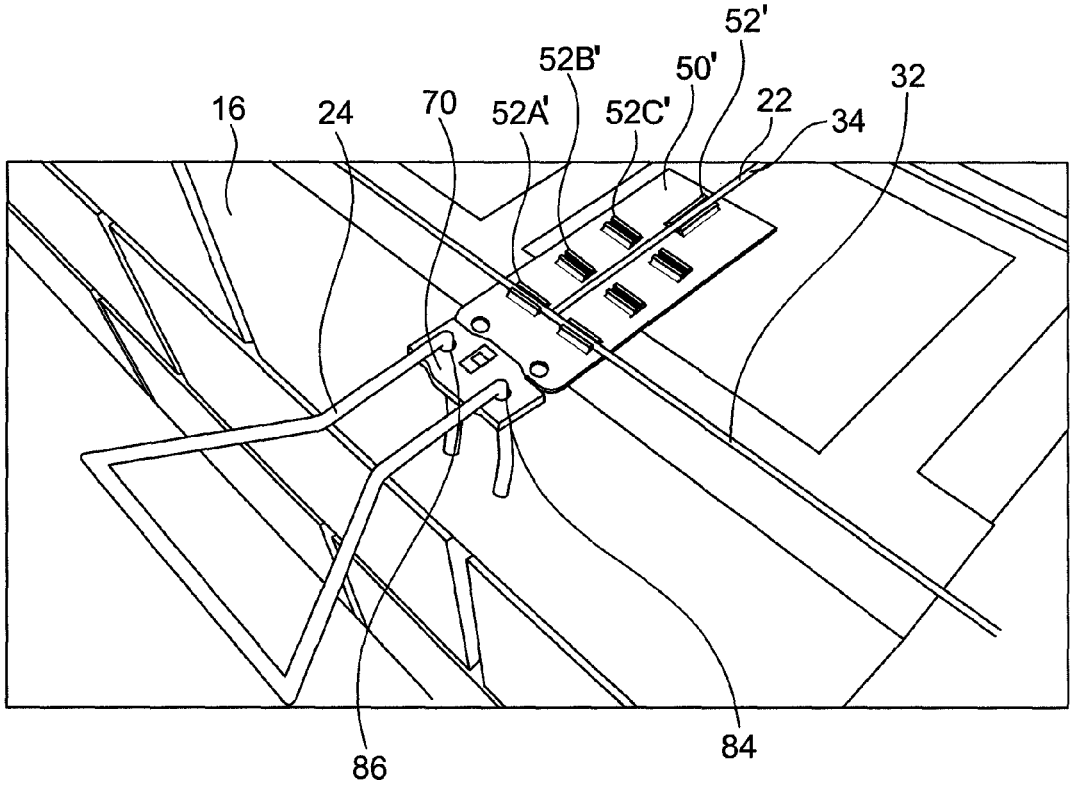
FIG. 9 is a sectional view of a masonry veneer wall and a supportive wall having a masonry wall wire reinforcement system in accordance with an alternative embodiment of the present invention.

FIG. 9 shows the alternative embodiment clip 50' in use with the thermal attachment 70 and a pintle tie 24. Once a layer of the inner wall 16 is built and the masonry wire reinforcement product 22 has been placed over the layer, the clip 50' can be secured to the masonry wire reinforcement product 22. As shown, the clip 50' has been secured to the masonry wire reinforcement product 22 in three places such that the vertical strut 34 is located in one groove 52' and the horizontal strut 32 is located in two grooves 52A'. This location allows for the openings 84, 86 on the thermal attachment 70 to be located a distance from the inner wall 16.

To the extent a greater distance is required from the inner wall 16 to the openings 84, 86, the clip 50' can be located such that grooves 52B' secure and support horizontal strut 32. To the extent an even greater distance is required from the inner wall 16 to the openings 84, 86, the clip 50' can be located such that grooves 52C' secure and support horizontal strut 32. Again, using one clip 50', three different distances can be generated depending on the distance required from the inner wall 16 to the outer wall 10 and due to the insulation needed for the structure.

Further, the clip 50, 50' described herein may contain additional openings to allow the mortar to better adhere to the clip 50, 50' and better adhere the clip 50, 50' to the CMU 18 of the inner wall 16.

Figure 10:
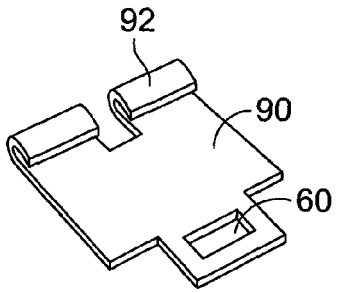
FIG. 10 is a perspective view of a clip for use in a masonry wall wire reinforcement system in accordance with an alternative embodiment of the present invention.

As described herein, there are numerous designs that would accomplish the same advantages as the preferred embodiments and the alternative embodiments described in detail herein. FIG. 10 shows yet another alternative embodiment in which a snap-on clip 90 is configured to snap on to the masonry wire reinforcement product 22 at the two snaps 92. The snap-on clip 90 would then sit between CMU 18 similarly to the clip 50, 50' described herein and once set, a thermal attachment 70 can be attached to the snap-on clip 90 by folding or closing first side 72 onto second side 74 over the opening 60. Once secured, the pintle tie 24 can be inserted into clip openings 54 and the veneer wall 10 can be built. To accommodate different length requirements, different size snap-on clips can be used.

Figure 11:
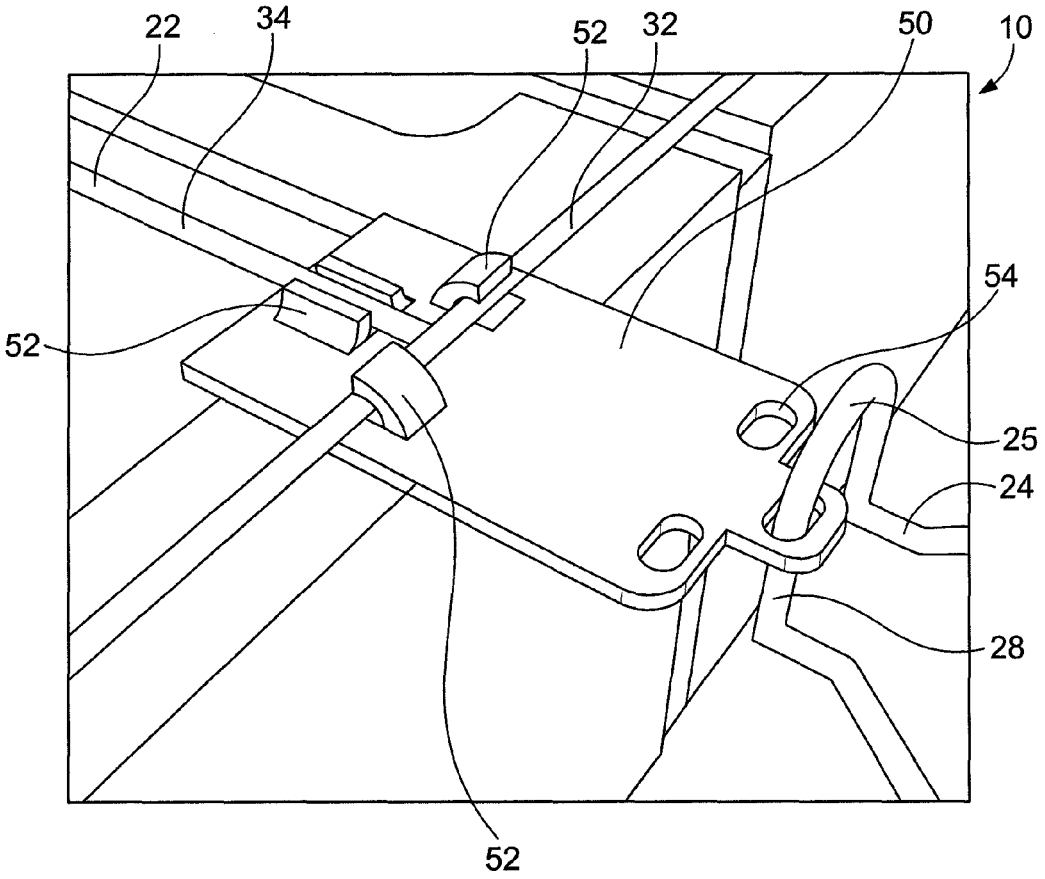
FIG. 11 is a sectional view of a masonry veneer wall and a supportive wall having a masonry wall wire reinforcement system in accordance with an alternative embodiment of the present invention.

In yet another embodiment shown in FIG. 11, the clip 50, as previously described herein, includes a number of hooks or clasps 52 at one end of the clip 50, again sized and configured to allow for the struts 32, 34, 38 and webs 40 (40 not shown) of the masonry wire reinforcement product 22 to be inserted, placed or "snapped" into the hooks or clasps 52 and held firmly in place. It should be understood that each of the different supports, such as grooves, hooks, clasps, indents, etc. 52 can be used interchangeably or in combination with the other embodiments to achieve similar results. Again, the clip 50 shown in FIG. 11 is intended to be used with a ladder type 30 wire reinforcement product 22, however, the clip 50 can be configured to be used with a truss type 36 wire reinforcement product 22 (see FIG. 2).

This alternative embodiment includes a clip 50 configured with three clip openings 54 at the end of the clip 50 opposite from the grooves 52, although more or less clip openings 54 can be used. In this embodiment, the clip openings 54 are oval shaped, and as with the other embodiments herein, the clip openings can be circular, oval or any other shape that will accept and support a pintle tie. As described herein, these clip openings 54 are used to accept the pintle ties 24, and allow for the pintle ties 24 to be positioned vertically depending on the height of the bricks 12 of the veneer wall 10.

FIG. 11 shows three clip openings 54, however, in this embodiment only one clip opening 54 is actually being used to hold the pintle tie 24. In use, the pintle tie 24 is placed into the clip opening 54 and slid around until the loop portion 25 of the pintle tie 24 is located at the clip opening 54. Whether the clip 50 uses one, two or more clip openings, as described herein, the clip 50 may also be configured to allow for a thermal attachment to be secured to the clip 50.

It will be appreciated that in addition to the structure of the masonry wire reinforcement system and apparatus described herein, another aspect of the present disclosure is a method for installing masonry wire reinforcement products. It will be further appreciated that the methodology and constituent steps thereof performed and carried out by an installer of the masonry wire reinforcement system, and described in great detail above, apply to this aspect of the disclosure with equal force. Therefore, the description of the methodology performed or carried out by an installer using the masonry wire reinforcement system as set forth above will not be repeated in its entirety.

While the disclosure is susceptible to various modifications and alternative forms, specific exemplary embodiments thereof have been shown by way of example in the drawings and have herein been described in detail. It should be understood, however, that there is no intent to limit the disclosure to the particular embodiments disclosed, but on the contrary, the intention is to cover all modifications, equivalents, and alternatives falling within the scope of the disclosure as defined by the appended claims.

What is claimed is:

1. A masonry wire reinforcement system comprising:

a masonry wire reinforcement apparatus, said apparatus having struts and being configured to be placed on top of a first layer of an inner support wall and placed under a second layer of said inner support wall;

a clip; said clip configured with at least one support, said at least one support configured and located to accept and support said struts on said masonry wire reinforcement apparatus;

said clip further configured with at least one clip opening, such that a pintle tie can be placed into the at least one clip opening, and said pintle tie can be located and supported by an outer veneer wall, such that said masonry wire reinforcement apparatus, said clip and said pintle tie establish a positive lateral load connection between said outer veneer wall and said inner support wall; and a thermal attachment wherein said thermal attachment has at least one thermal attachment opening and is configured to be attached to the clip, said thermal attachment is further configured to receive the pintle tie in the at least one thermal attachment opening, such that said masonry wire reinforcement apparatus, said clip, said thermal attachment and said pintle tie establish a positive lateral load connection between said outer veneer wall and said inner support wall.

2. The masonry wire reinforcement system of claim 1, wherein said clip is configured with multiple supports that can be used depending on the distance between the outer veneer wall and the inner support wall.

3. The masonry wire reinforcement system of claim 1, wherein said clip is manufactured entirely or partially from zinc alloy or stainless steel, and is either mill galvanized, epoxy coated or hot dipped galvanized.

4. The masonry wire reinforcement system of claim 1, wherein said at least one support comprises a groove, hook, clasp or indent.

5. The masonry wire reinforcement system of claim 1, wherein said at least one clip opening comprises a circle or an oval.

6. The masonry wire reinforcement system of claim 1, wherein said pintle tie can be moved in a vertical direction after being placed into the at least one opening of said clip and prior to being located and supported by said outer veneer wall.

7. The masonry wire reinforcement system of claim 1, wherein said thermal attachment is manufactured entirely or partially from plastic or plastic resin.

8. A method of assembling a masonry wire reinforcement system between an outer veneer wall and an inner support wall, the method comprising the steps of:

placing a masonry wire reinforcement apparatus on top of a first layer of an inner support wall and under a second layer of said inner support wall, said apparatus having struts;

attaching a clip to said masonry wire reinforcement apparatus; said clip configured with at least one support and at least one clip opening, said at least one support configured and located to accept and support said struts on said masonry wire reinforcement apparatus;

attaching a thermal attachment to the clip, wherein said thermal attachment has at least one thermal attachment opening, and said thermal attachment is further configured to receive a pintle tie in the at least one thermal attachment opening; and accepting the pintle tie into said at least one thermal clip opening, such that said pintle tie can be located and supported by an outer veneer wall, and such that said masonry wire reinforcement apparatus, said clip, said thermal attachment and said pintle tie establish a positive lateral load connection between said outer veneer wall and said inner support wall.

9. The method of assembling a masonry wire reinforcement system between an outer veneer wall and an inner support wall of claim 8, wherein said clip is configured with multiple supports that can be used depending on the distance between the outer veneer wall and the inner support wall.

10. The method of assembling a masonry wire reinforcement system between an outer veneer wall and an inner support wall of claim 8, wherein said clip is manufactured entirely or partially from zinc alloy or stainless steel, and is either mill galvanized, epoxy coated or hot dipped galvanized.

11. The method of assembling a masonry wire reinforcement system between an outer veneer wall and an inner support wall of claim 8, wherein said at least one support comprises a groove, hook, clasp or indent.

12. The method of assembling a masonry wire reinforcement system between an outer veneer wall and an inner support wall of claim 8, wherein said at least one clip opening comprises a circle or an oval.

13. The method of assembling a masonry wire reinforcement system between an outer veneer wall and an inner support wall of claim 8, wherein said pintle tie can be moved in a vertical direction after being placed into the at least one opening of said clip and prior to being located and supported by said outer veneer wall.

14. The method of assembling a masonry wire reinforcement system between an outer veneer wall and an inner support wall of claim 8, wherein said thermal attachment is manufactured entirely or partially from plastic or plastic resin.

* * * * *